US005529628A

United States Patent [19]

Fuchiwaki et al.

[11] Patent Number: 5,529,628

[45] Date of Patent: Jun. 25, 1996

[54] DEVELOPING UNIT

[75] Inventors: Takashi Fuchiwaki; Yoshikazu Okamoto, both of Ebina; Ryuji Gotoh, Tomioka, all of Japan

[73] Assignees: Fuji Xerox Co., Ltd.; Hitachi Metals, Ltd., both of Tokyo, Japan

[21] Appl. No.: 531,068

[22] Filed: Sep. 20, 1995

[30] Foreign Application Priority Data

Mar. 23, 1994 [JP] Japan ..... 6-075457

[51] Int. Cl.[6] ..... G03G 15/09

[52] U.S. Cl. ..... 118/658; 355/251

[58] Field of Search ..... 118/658; 355/251

[56] References Cited

U.S. PATENT DOCUMENTS 4,331,100 5/1982 Mochizuki et al. ..... 118/657

FOREIGN PATENT DOCUMENTS 62-55149 11/1987 Japan .
3-291680 12/1991 Japan .

*Primary Examiner*—Joan H. Pendegrass
*Assistant Examiner*—Quana Grainger
*Attorney, Agent, or Firm*—Oliff & Berridge

[57] ABSTRACT

A developing roll includes a tubular sleeve driven for turn, and a magnet roll fixedly supported. An intensively magnetized block, shaped like U in cross section, is buried in the magnet roll at a location thereof where the magnet roll faces the latent electrostatic image bearing member. In this case, one side of the intensively magnetized block having a groove formed therein is directed toward the axis of the magnet roll, while the other side thereof is flush with the outer surface of the magnet roll. A material of the intensively magnetized block is more intensively magnetized, by its nature, than a material of the magnet roll. The intensively magnetized block is magnetized to form a single magnetic pole or a developing magnetic pole.

4 Claims, 7 Drawing Sheets

□,○ : THE DEVELOPING ROLL OF TYPE IN WHICH A GROOVE IS FORMED IN THE OUTER SURFACE OF THE MAGNET ROLL

■,● : THE DEVELOPING ROLL OF THE PRESENT INVENTION

DEVELOPING UNIT

BACKGROUND OF THE INVENTION

The present invention relates to a developing unit in use with an image recording apparatus based on the xerography process, such as a copying machine or a printer. More particularly, the invention relates to a developing unit which can provide a quality image of sufficiently high density.

In the xerography-basis image recording apparatus and the electrostatic image recording apparatus, there is known a process to visualize a latent electrostatic image on the image bearing member by using a two-component developer consisting of non-magnetic toner and magnetic carriers. In the process, a magnetic brush consisting of strings of magnetic carriers that are like ears is formed on the developing roll. The sleeve is rotated above the surface of the developing roll, to thereby transport the magnetic brush to a location where it faces the latent electrostatic image bearing member. The non-magnetic toner is transferred onto the latent image on the latent electrostatic image bearing member.

A developing roll as shown in FIG. 9 is generally used for the developing unit. The developing roll includes mainly a magnet roll 61 and a sleeve 60 that is rotatable with respect to the magnet roll 61. The magnet roll 61 is formed by sintering powdery ferromagnetic material, such as hard ferrite, or molding a mixture of powdery ferromagnetic material and binder into a cylindrical body. A plural number of magnetic poles are circumferentially arrayed therein, each magnetic pole being uniform in the axial direction. A support shaft, which is extended passing through the central part of the magnet roll 61, fixedly supports the magnet roll 61. Both ends of the support shaft, extended from both sides of the magnet roll 61, are supported by a housing of the developing unit. The sleeve 60 is a tubular member made of non-magnetic material, such as aluminum alloy or stainless steel. The sleeve 60, driven for rotation, is supported by a supporting member that is rotatably mounted on the support shaft.

The two-component developer is attracted to the circumferential, outer surface of the sleeve 60 through the magnetic interaction by the magnet roll 61, so that a magnetic brush is formed on the sleeve 60. With rotation of the sleeve 60, the magnetic brush is moved to the developing region where non-magnetic toner is transferred onto a latent electrostatic image bearing member 40 in an electric field present between the sleeve 60 and the latent electrostatic image bearing member 40, thereby developing the latent electrostatic image.

The magnetic brush, as shown in FIG. 10, is formed on the sleeve, along the magnetic lines of force between the adjacent S and N poles of the magnet roll 61. In the figure, the distributions of magnetic flux developed from only the outer surface area of the magnet roll 61 where it faces the latent electrostatic image bearing member 40 are illustrated. As known, the remaining outer surface develops magnetic fluxes in similar fashion. The magnetic field is the most intensive at the center of a magnetic pole that develops the magnetic flux. The magnetic flux developed from one magnetic pole is extended toward its adjacent other magnetic poles. Accordingly, the magnetic ear formed along the line prolonged perpendicularly from the center of the magnetic pole is the highest, and the magnetic ear is the lowest in the middle between the adjacent magnetic poles. For this reason, the magnetic poles are usually arrayed in the magnet roll 61 such that the developing process is carried out in a region containing the highest magnetic ear and its near ears.

In the developing process, some techniques for increasing a density of the image are known. The first technique is to turn the developing roll at high speed. The second technique is to reduce the gap between the developing roll and the latent electrostatic image bearing member. The third measure is to enlarge the developing region. Those techniques have the following problems. In the first technique based on the high speed rotation of the developing roll, toner is scattered within the machine. In the second technique based on the gap reduction, the developer tends to agglomerate under a pressure, and in an extreme case, it will damage the latent electrostatic image bearing member. The third technique, which is based on the enlargement of the developing region, is realized by using a plural number of the developing rolls, widening the magnetic poles, and the like. Where the plural number of the developing rolls are used, the machine size and the cost to manufacture as well are increased. Where the magnetic poles are widened, the machine size is not increased, but the magnetic flux density is increased. Under the increased magnetic flux density, the developer attaches in a large brush onto the sleeve, it receives a pressure from the latent electrostatic image bearing member 40, and hence tends to agglomerate.

A technique capable of preventing the agglomeration of the developer and the increase of the machine size is proposed. In the proposed technique, the magnetic poles are arranged in the developing roll so that the magnetic field has a plural number of peaks of its intensity in the developing region. The technique is realized in a manner that two magnets of the same polarity, arrayed parallel to each other, are disposed in the portion of the developing roll where it faces the latent electrostatic image bearing member. The same is also realized in a manner that a magnet is disposed in the developing region while facing the latent electrostatic image bearing member, and at least one dent is formed on the side of the magnet where it faces the latent electrostatic image bearing member (U.S. Pat. No. 4,331,100 and Published Unexamined Japanese Patent Application No. Hei. 3-291,680).

The technique in which the plural number of intensity distribution peaks of the magnetic field are formed in the developing region has the following problems. Careful and troublesome work is required for fixing the two parallel magnets at the designed locations. This leads to increase of cost to manufacture. Further, a magnetic field, which is opposite to the intended magnetic field, is developed in the gap between the two magnets. By the unwanted magnetic field, toner attaches to portions in the latent image which should not be developed. The resultant image is not clear.

In the approaches of U.S. Pat. No. 4,331,100 and Published Unexamined Japanese Patent Application No. Hei. 3-291,680, the dent is formed on the side of the magnet where it faces the latent electrostatic image bearing member. With provision of the dent, a magnetic field on the surface of the sleeve abruptly changes at the location of the dent on the magnet. In other words, a magnetic field gradient is great on the outer surface of the sleeve. In such a magnetic field, the magnetic brush formed on the sleeve is abruptly agitated, so that toner is scattered. The shape and size of the dent greatly affects an intensity distribution of the magnetic field. Because of this, to obtain a profile of the intensity distribution of the magnetic field as designed, the dent must be formed by a high precision work. To this end, a highly skilled technique is required. The result is increase of cost to manufacture.

SUMMARY OF THE INVENTION

The present invention has been made in view of the above circumstances and has an object to provide a developing unit which is capable of increasing an optical density of a developed image by enlarging the developing region, and does not require a high skill for its manufacturing.

To solve the above object, there is provided a developing unit having a developing roll including a tubular sleeve disposed facing a latent electrostatic image bearing member, the sleeve being driven for turn in the circumferential direction, and a cylindrical magnet roll fixedly supported within the sleeve, in which a magnetic brush of a two-component developer is formed on the sleeve, and with turn of the sleeve, the two-component developer is transported to a developing region where it faces the latent electrostatic image bearing member, and in the developing region, a latent electrostatic image on the latent electrostatic image bearing member is developed into a visible image, characterized in that the magnet roll includes a substantially cylindrical roll base made of a magnetic material, and an intensively magnetized block buried in the magnet roll at a location thereof where the magnet roll faces the latent electrostatic image bearing member, the intensively magnetized block being made of a material that is more intensively magnetized, by its nature, than a material of the magnet roll, the intensively magnetized block being shaped like U in cross section to form a groove that is uniformly extended over the substantially entire axial length of the magnet roll, the U-shaped side of the intensively magnetized block being directed toward the axis of the magnet roll, and the intensively magnetized block thus buried being magnetized to form a single magnetic pole in the magnet roll.

In the developing unit, the groove of the intensively magnetized block may be empty. A part of the roll base may fill the groove of the intensively magnetized block. With this construction, an optimum intensity distribution of a magnetic field can readily be formed.

The intensively magnetized block is extended over the substantially entire axial length of the magnet roll. The intensity of a magnetic field developed from the intensively magnetized block and the length thereof extended in the circumferential direction may properly selected. The groove of the intensively magnetized block is also extended over the substantially entire axial length of the magnet roll. The shape and size of the groove may properly be selected in accordance with a distribution of the magnetic field required for the developing unit.

The intensively magnetized block is made of a material to be intensively magnetized by its nature, such as a ferromagnetic material of high susceptibility or a hardened mixture of powdery ferromagnetic material and a binder. The roll base is made of a material that has a lower susceptibility than a material of the intensively magnetized block. It is preferable that the roll base of the magnet roll is made of an isotropic ferrite magnetic material, and the intensively magnetized block is made of an anisotropic ferrite magnetic material.

The intensively magnetized block is buried in the surface region of the roll base of the magnet roll at a location thereof where the magnet roll faces the latent electrostatic image bearing member. The intensively magnetized block is shaped like U in cross section to form a groove that is uniformly extended over the substantially entire axial length of the magnet roll. The U-shaped side of the intensively magnetized block is directed toward the axis of the magnet roll. The intensively magnetized block being made of a material that is more intensively magnetized, by its nature, than a material of the magnet roll. The intensively magnetized block thus buried is magnetized to form a single magnetic pole in the magnet roll. With this construction, an intensity distribution of a magnetic field developed on the surface of the sleeve is profiled as indicated by a solid line B in FIG. 2, for example. As shown, the intensity distribution profile has peaks at near to the legs (extended in the radial direction) of the magnet block, which define the groove. Accordingly, a brush-like developer (magnetic brush) attracting onto the portions of the sleeve which are located in the intensive magnetic field is brought into contact with an enlarged area on the surface of the latent electrostatic image bearing member. The developing region is larger than that of the conventional developing unit which produces a magnetic field profile having a single peak in the developing region (indicated by a broken line A in FIG. 2). When the magnetic brush on the sleeve passes the trough between the peaks where the magnetic field is weak, it temporarily loses its shape. The magnetic brush that lost toner attached to the ear tip through the development is temporarily stirred, so that strings of magnetic carriers are renewed. Toner staying at the root of the magnetic brush additionally contributes to the development, thereby providing a satisfactory density of the developed image.

The groove of the intensively magnetized block is directed toward the axis of the magnet roll. Because of this, the gradient of the intensity distribution profile is more gentle than that in the developing unit in which the dent is formed in the outer surface of the magnet roll (FIG. 8). Accordingly, the disturbance of the magnetic brush is not abrupt. Hence, toner is not scattered.

When the groove of the intensively magnetized block is directed toward the axis of the cylindrical magnet roll, a change of the intensity distribution of the magnetic field, such as the difference between the magnetic flux density at the peak and the magnetic flux density at the bottom of the trough between the peaks, which the change depends on the depth and the shape of the groove, is more gentle than when the groove of the intensively magnetized block is directed to the outside of the magnet roll. Accordingly, a high skill is not required for working the intensively magnetized block to form the groove and the shape thereof. Simplification of the work and cost reduction are realized.

A part of the roll base that has a lower susceptibility than the intensively magnetized block may fill the groove of the intensively magnetized block. Alternatively, the groove of the intensively magnetized block may be empty. Therefore, an optimum intensity distribution of a magnetic field can readily be formed.

DETAILED DESCRIPTION OF THE PREFERRED EMBODIMENTS

The preferred embodiments of the present invention will be described with reference to the accompanying drawings.

Figure 1:
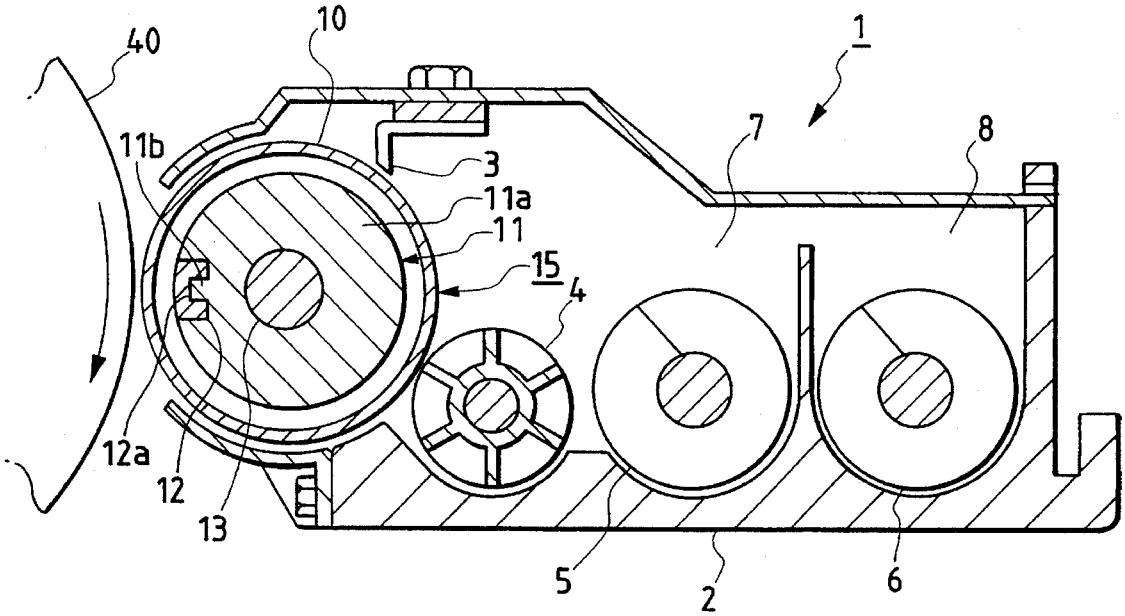
FIG. 1 is a view showing a developing unit according to an embodiment of the present invention.

FIG. 1 is a view showing a developing unit according to an embodiment of the present invention. As shown, the developing unit 1 is disposed facing a latent electrostatic image bearing member 40 which is capable of forming a latent electrostatic image in the form of different charge potentials on the surface thereof. A housing 2 of the developing unit 1 contains a developing roll 15, a developer regulating member 3, and a paddle 4. The developing roll 15 is disposed facing the latent electrostatic image bearing member 40, and capable of attracting developer to the surface thereof and transporting it to a developing region. The developer regulating member 3 regulates the amount of developer on the developing roll 15. The paddle 4 supplies the developer to the developing roll 15. Further contained in the housing 2 are a first agitating chamber 7 and a second agitating chamber 8 of which the axes are parallel to the axis of the developing roll 15. The first and second agitating chambers 7 and 8 are provided with a first auger 5 and a second auger 6, respectively. These augers 5 and 6 transport the developer while agitating the developer.

The latent electrostatic image bearing member 40 has the circumferential, outer surface on which a photoreceptor (opc photoreceptor) made of a high polymer compound is layered. The photoreceptor surface of the latent electrostatic image bearing member 40 is uniformly charged, and an image forming area thereon is exposed to light containing image information, to thereby form a latent electrostatic image thereon.

The developing roll 15 includes a cylindrical magnet roll 11 and a tubular sleeve 10. A plural number of magnetic poles are circumferentially arrayed in the surface region of the developing roll 15. The tubular sleeve 10, made of non-magnetic material, is disposed around the developing roll 15 and rotatable with respect to the developing roll 15. More specifically, the tubular sleeve 10 is made of SUS304, and the outside diameter of the tubular sleeve 10 is 24.5 mm. The cylindrical magnet roll 11, disposed within the tubular sleeve 10, has the outside diameter of 22 mm. The cylindrical magnet roll 11 is formed with a roll base 11*a*, a magnet block 12 (intensively magnetized block), and a shaft 13. The roll base 11*a* is formed by sintering powdery ferrite. The magnet block 12 is buried in the surface region of the roll base 11*a* of the cylindrical magnet roll 11 in a state that it extends over the full width (as viewed in the axial direction) of the cylindrical magnet roll 11 and faces the latent electrostatic image bearing member 40. The shaft 13 supports the roll base 11*a*.

The magnet block 12 includes a groove 12*a* that is uniform in shape and size in the axial direction of the cylindrical magnet roll 11. The magnet block 12 is buried in the surface region of the roll base 11*a* at the location thereof where the magnet roll faces the latent electrostatic image bearing member 40, in a state that the groove 12*a* thereof is directed toward the axis of the cylindrical magnet roll 11. A protruded part 11*b* of the roll base 11*a* fills the groove 12*a* of the magnet block 12. The magnet block 12 and part of the roll base 11*a* near the magnet block are magnetized into a single magnetic pole or a developing magnetic pole. In addition to the developing magnetic pole, other magnetic poles (not shown) that also extended uniformly in the axial direction, are circumferentially arrayed in the roll base 11*a*.

The magnet block 12 is formed by sintering a powdery ferrite. A magnetically anisotropic material is used for the magnet block 12, to obtain a strong magnetic force. In the present embodiment, an anisotropic ferrite magnet (YBM-2B, manufactured by Hitachi Metals, Ltd.) is used and the dimensions thereof are: width (in the circumferential direction)= 7 mm; height (in the radial direction)= 5 mm; length (in the axial direction)=220 mm; and gap width of the groove 12*a* (in the circumferential direction)= 4 mm. The roll base 11*a* is made of a magnetically isotropic material, such as the sintered powdery ferrite or resin containing ferrite. In the present embodiment, an isotropic ferrite magnet (YBM-3, manufactured by Hitachi Metals, Ltd.) is used and the dimensions thereof are: outside diameter= 22 mm; inside diameter= 10 mm; and axial length= 220 mm. The shaft 13 is made of SUS304, and the dimensions of it are: outside diameter=10 mm and the axial length= 350 mm.

The cylindrical magnet roll 11 forms a magnetic brush of two-component developer as a mixture of magnetic carriers and toner on the surface of the tubular sleeve 10 by a magnetic field formed between the adjacent magnetic poles in the roll base 11*a*. With rotation of the sleeve 10, the magnetic brush is moved to the developing region. The developing region is defined by the surfaces of the developing roll 15 and the latent electrostatic image bearing member 40 which are proximate to each other.

The developer regulating member 3 is protruded toward the surface of the tubular sleeve 10 so that its tip is in proximity with the surface of the sleeve 10. The developer regulating member 3 so arranged regulates the amount of developer that is attracted to the surface of the sleeve 10, to thereby form a developer layer of uniform thick.

Adjacent to the developing roll 15, the first agitating chamber 7 is disposed in parallel with the developing roll 15. In the first agitating chamber 7, the first auger 5 and the paddle 4 turn to feed developer to the developing roll 15. Both sides (as viewed in the axial direction of the developing roll) of the second agitating chamber 8 are continuous to both sides of the first agitating chamber 7, respectively. The second auger 6 transports the developer in the direction opposite to the direction in which the first auger 5 transports the developer.

In the developing unit thus constructed, the developer is moved in a circulative fashion within the first and second agitating chambers 7 and 8, so that the magnetic carriers and toner are sufficiently agitated. Toner is sufficiently charged, and the charged toner is supplied to the surface of the developing roll 15. The developer, which has been supplied to the developing roll 15, forms a magnetic brush on the sleeve 10 in the magnetic field by the cylindrical magnet roll 11. With rotation of the sleeve 10, the magnetic brush is transported to the developing region, through the developer regulating member 3 by which the amount of the developer is regulated. In the developing region, toner is transferred onto the image forming area on the latent electrostatic image bearing member 40, thereby developing the latent electrostatic image thereon into a visible image.

Figure 2:
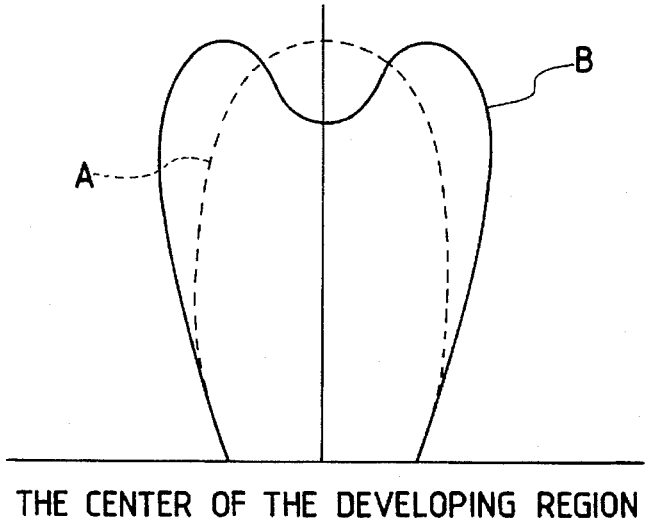
FIG. 2 is a graph showing an intensity distribution of a magnetic field in the developing region in the developing unit of FIG. 1.
Figure 3A:
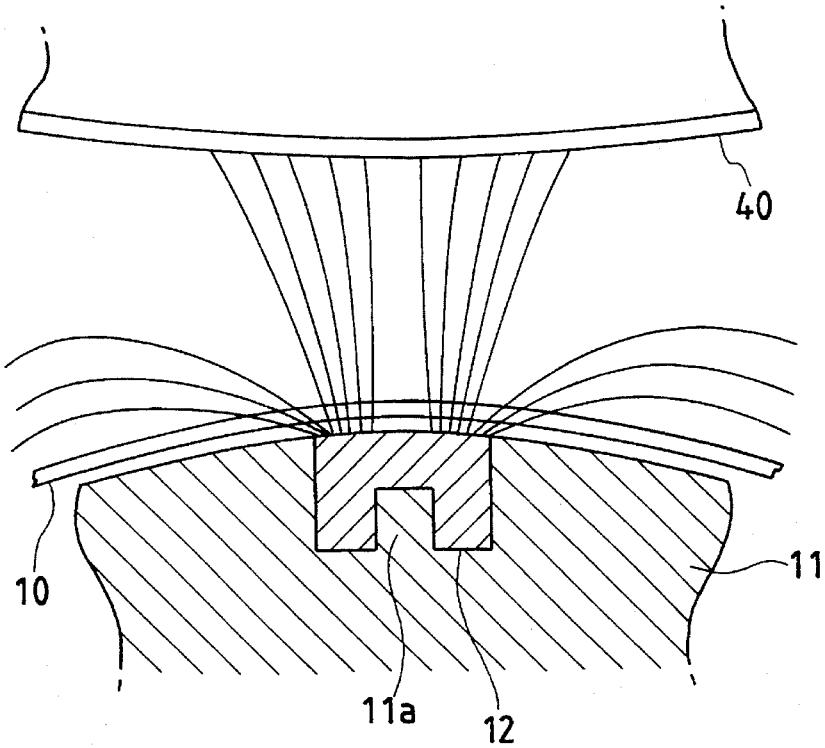
FIGS. 3A and 3B are diagrams showing a distribution of magnetic lines of flux in the developing region of the developing unit of FIG. 1, and a magnetic brush formed therein.
Figure 3B:
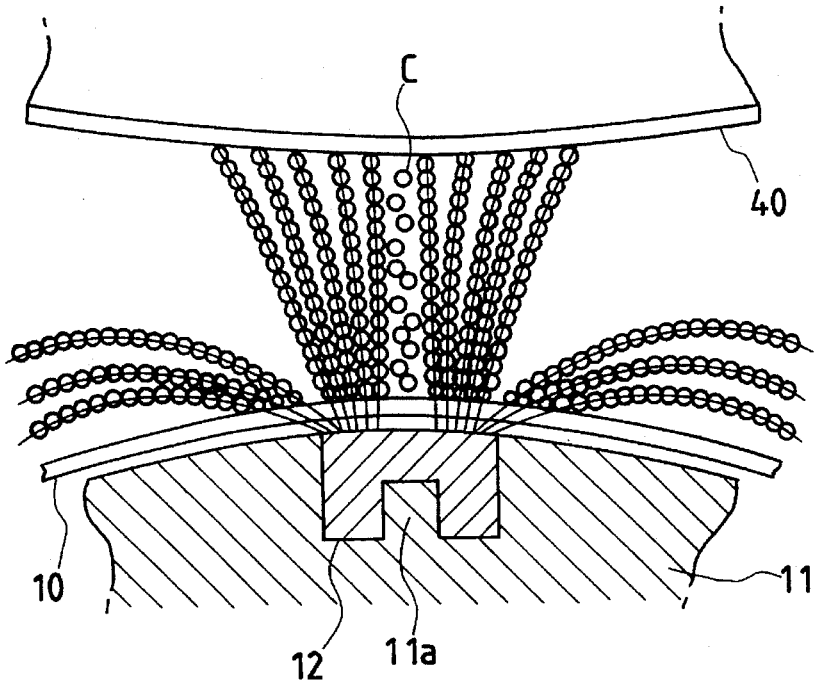

In the present embodiment, the magnet block 12 is buried in the surface region of the roll base 11*a* at the location thereof where the magnet roll faces the latent electrostatic image bearing member 40, in a state that the groove 12*a* thereof is directed toward the axis of the cylindrical magnet roll 11. A part of the roll base 11*a* of low susceptibility fills the groove 12*a* of the magnet block 12. A profile of an intensity distribution of the magnetic field in the developing region has two peaks at near to the legs (extended in the radial direction) of the magnet block 12, which define the groove 12*a*. A profile of the intensity distribution of the magnetic field developed by the magnetic pole of the conventional cylindrical magnet roll, has a single peak as indicated by a broken line A in FIG. 2. In the present embodiment, a profile of the intensity distribution of the magnetic field developed by the magnet block 12 has two peaks at both sides of the groove 12*a* of the magnet block, as indicated by a solid line B. Therefore, in the developing region where the developing roll 15 confronts with the latent electrostatic image bearing member 40, a magnetic flux as shown in FIG. 3A is formed. As seen, the magnetic field formed by the developing unit of the present embodiment has such an intensity as to be required for the development over a broader area than the magnetic field by the conventional developing unit has. In the magnetic field thus distributed, a magnetic brush as shown in FIG. 3B is formed. As shown, the magnetic brush contacts with the latent electrostatic image bearing member over a broader area. In other words, the developing region is broadened.

The profile of the intensity distribution of the magnetic field, which has two peaks in the developing region, shows that the magnetic field is weak in a trough or a region between the two peaks. In the present embodiment, the magnetic field is 1200 G at each peak point of the profile, and 900 G in the trough. Two gradients range from the trough to the peaks in the intensity distribution profile of the magnetic field. When the magnetic brush on the sleeve 10 passes the trough of the magnetic field, it temporarily loses its shape (indicated by character C in FIG. 3B). The magnetic brush that lost toner attached to the ear tip through the development is temporarily stirred. When the magnetic brush is stirred, toner attached to other part than the ear tip also flies to the latent electrostatic image on the latent electrostatic image bearing member, to thereby contribute to the development of the latent electrostatic image. The result is a further improvement of the image density. It is noted here that the gradients between the peaks in the intensity distribution profile of the magnetic field are more gentle than that in the intensity distribution profile by the conventional developing unit (U.S. Pat. No. 4,331,100). This fact indicates that the stirring of the magnetic brush is not abrupt, and hence toner is not scattered.

Figure 4:
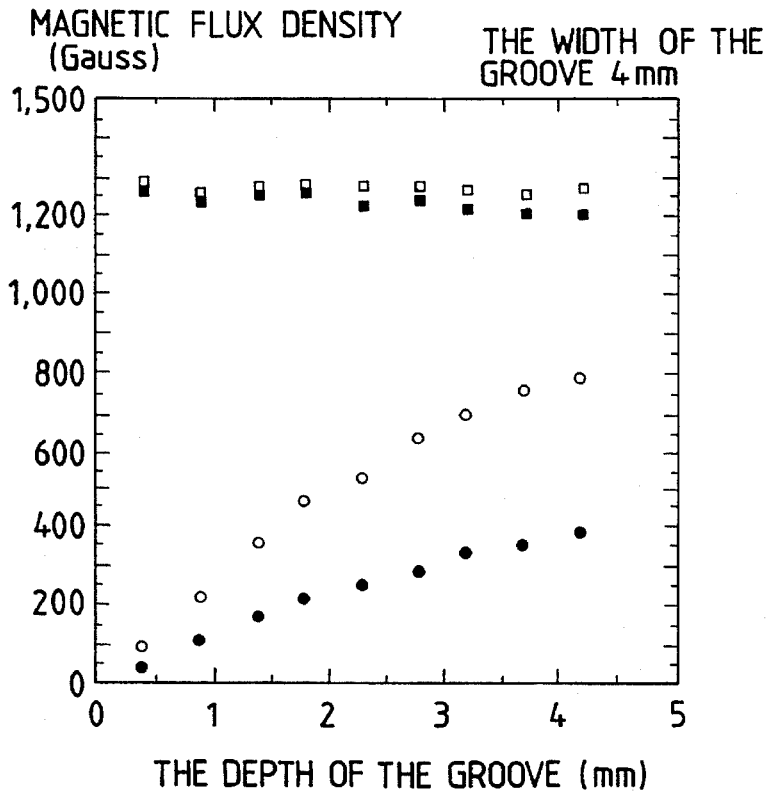
FIG. 4 is a graph comparatively showing the distributions of magnetic flux densities in the developing region of the developing unit of FIG. 1, with respect to the depth of the groove of the magnet block, in comparison with a conventional developing roll.
Figure 4:
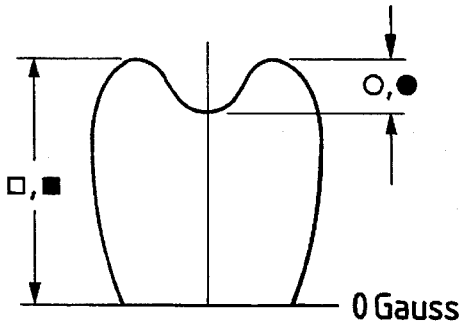
Figure 4:
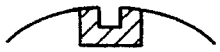
Figure 4:
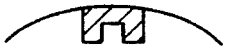

FIG. 4 is a graph comparatively showing the distributions of magnetic flux densities of the developing roll 15 of the present embodiment and the conventional developing roll (U.S. Pat. No. 4,331,100) of type in which a groove is formed in the outer surface of the magnet roll. In the figure, black and white squares indicate magnetic flux densities at the peaks in the intensity distribution profile of the magnetic field, and black and white circles indicate the difference between the magnetic flux density at the peak and the magnetic flux density at the bottom of the trough between the peaks. As seen from the graph, in the developing roll 15, a variation of the magnetic flux density difference with respect to the depth of the groove 12*a* varies is smaller than in the conventional developing roll. In other words, in the conventional developing roll, the intensity distribution of the magnetic field greatly varies depending on the size of the groove. Therefore, highly skilled technique is required for the work for forming the groove. On the other hand, in the developing roll of the present embodiment, if the size of the groove is varied more or less, the intensity distribution of the magnetic field is a little varied. Accordingly, the work for forming the groove is easy, and the cost to form the groove is remarkably reduced.

A method of manufacturing the developing unit 1 will be described. Ferrite is sintered into a magnet block 12 with a groove 12*a* of a predetermined shape. A mixture of powdery ferrite and binder is sintered into a substantially cylindrical roll base 11*a*. In this case, a groove for receiving the magnet block 12 and a protruded part 11*b* to be inserted into the groove 12*a* of the magnet block 12 are axially formed in advance in the surface region of the roll base 11*a*. The magnet block 12 is fit into the thus formed groove of the roll base 11*a*, fixed thereto, and the outer surface of the thus fit magnet block 12 is made flush with the outer surface of the roll base 11*a*. As a result, a cylindrical magnet roll with the smooth surface is manufactured.

Figure 5A:
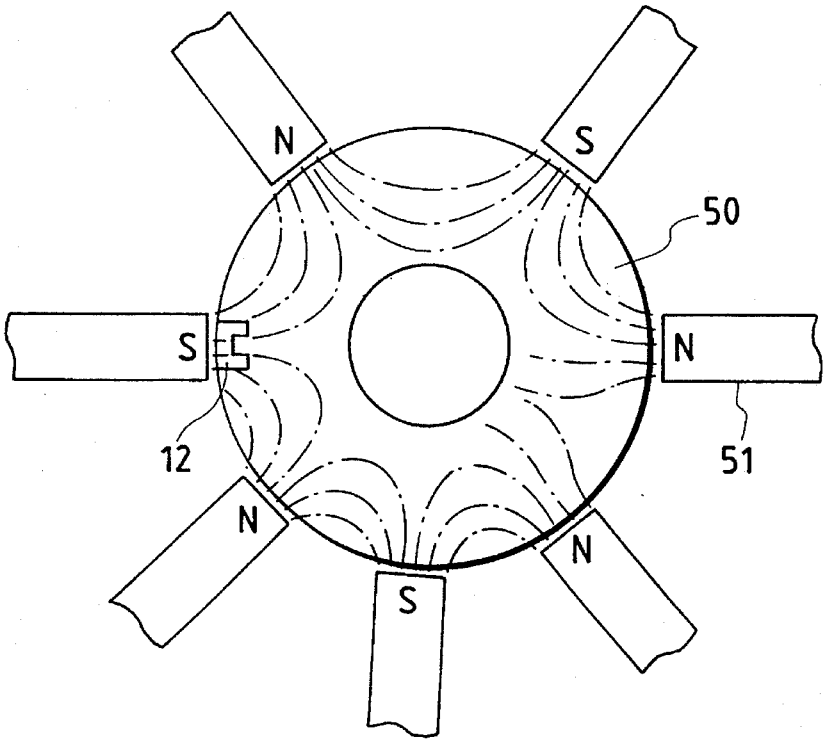
FIGS. 5A and 5B are diagrams showing a step for magnetizing the magnet roll in the process of manufacturing the developing unit of FIG. 1.
Figure 5B:
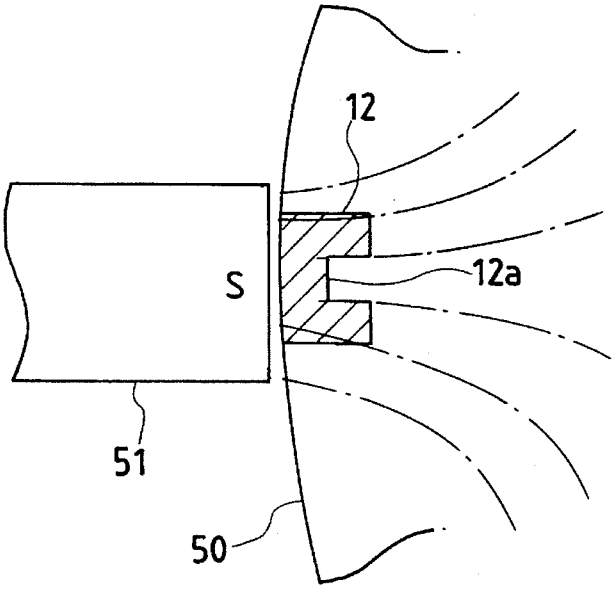

A plural number of magnetizing blades 51 are made to approach to the outer surface of the substantially cylindrical magnet roll, as shown in FIG. 5A. In this state, a plural number of magnetic poles are formed in the surface region of the magnet roll such that these poles are circumferentially arrayed in cross section, and uniformly extended over the substantially entire axial length of the magnet roll. In this case, a location of the magnet roll to which the magnet block 12 is fit, is magnetized in the same polarity (N pole in this embodiment) so that the magnet block 12 and the vicinity of the groove 12*a* of the magnet block form a single pole (FIG. 5B). When thus magnetized, the density of the magnetic field is peaked at the portions (the legs of the magnet block) on both sides of the groove 12*a* of the magnet block since the magnet block 12 is more intensively magnetized, by its nature, than its near part of the roll base 11*a*. When the cylindrical magnet roll 11 thus constructed is placed in the tubular sleeve 10, an intensity of the magnetic field is distributed as indicated by the solid line B in FIG. 2, on the sleeve 10 that is located above the surface of the developing roll.

The developing roll thus manufactured is assembled into the housing, to thereby complete a developing unit. The remaining steps to manufacture the developing unit may be the related steps of the conventional manufacturing method. In the above-mentioned method of manufacturing the developing unit, the height of two peaks of the magnetic field intensity distribution profile, the width of each peak portion, and the difference of height between each peak and the bottom of the trough between the peaks can be changed, as desired, by properly selecting the dimensions (height, width, and depth) of the magnet block 12, the dimensions of the groove 12*a*, and a kind of the material filling the groove 12*a*, which is less magnetized than the magnet block 12.

In another method of manufacturing the developing unit 1, a block 12 with a groove 12*a* is put in place in a substantially cylindrically shaped mold, and green resin containing powdery ferrite is poured into the mold for one-piece molding. Before the resin is cured, the magnetizing blades 51 are set around the mold to magnetize it to form a plural number of magnetic poles therein as in the manner as mentioned above. In this way, a cylindrical magnet roll 11 is manufactured as designed.

Figure 6:
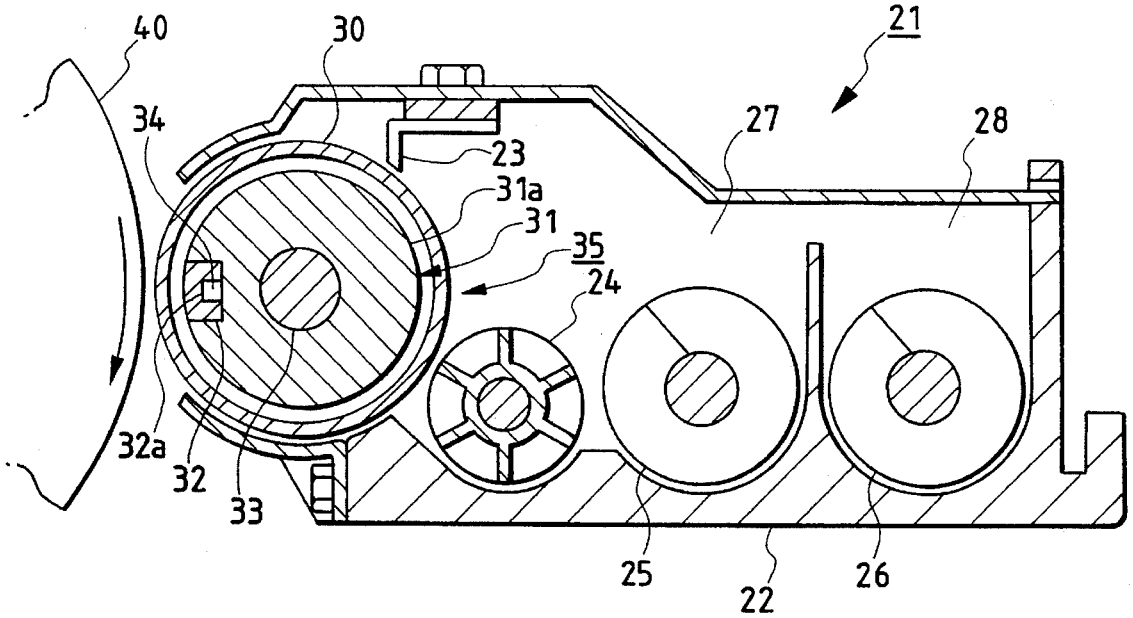
FIG. 6 is a view showing a developing unit according to another embodiment of the present invention.

Another embodiment of the present invention will be described with reference to FIG. 6. In a developing unit 21, a magnet block 32 having a groove 32*a* is also buried in a roll base 31*a* of a cylindrical magnet roll 31 as in the first embodiment. However, in the second embodiment, the groove 32*a* of the magnet block 32 is not filled with part of the roll base 31*a*, while in the first embodiment, the groove 12*a* of the magnet block 12 is filled with part of the roll base 11*a* of the cylindrical magnet roll 11. In other words, the cylindrical magnet roll 31 of the second embodiment is completed in a state that a space 34 is present in the groove 32*a* of the magnet block 32. The cylindrical magnet roll 31 and its near part of the roll base 31*a* are magnetized into a single magnetic pole. The material and the shape of the magnet block 32, and the material of the roll base 31*a* are the same as those in the developing unit 1 shown in FIG. 1. The remaining construction of the developing unit 21 are also the same as that of the developing unit 1.

Figure 7:
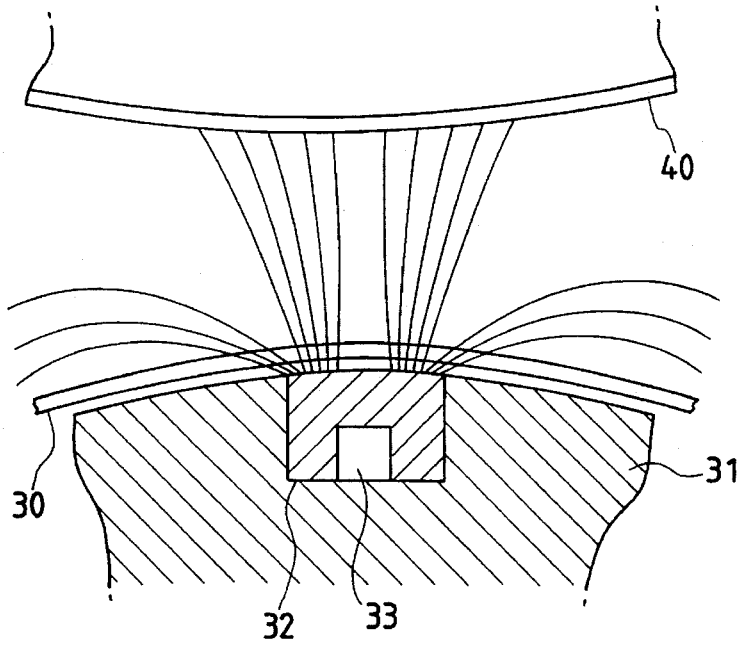
FIG. 7 is a diagram showing a distribution of magnetic lines of flux in the developing region in the developing unit of FIG. 6.
Figure 8:
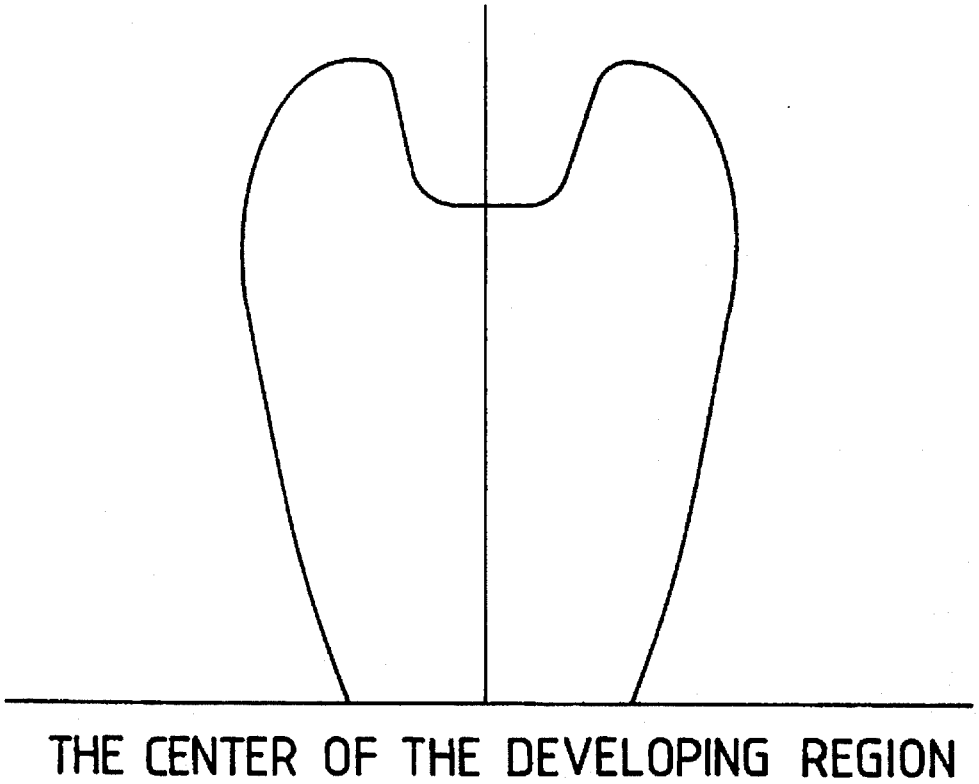
FIG. 8 is a graph showing a profile of an intensity distribution of a magnetic field in the developing region of a conventional developing unit, the profile having two peaks of the intensity of the magnetic field.
Figure 9:
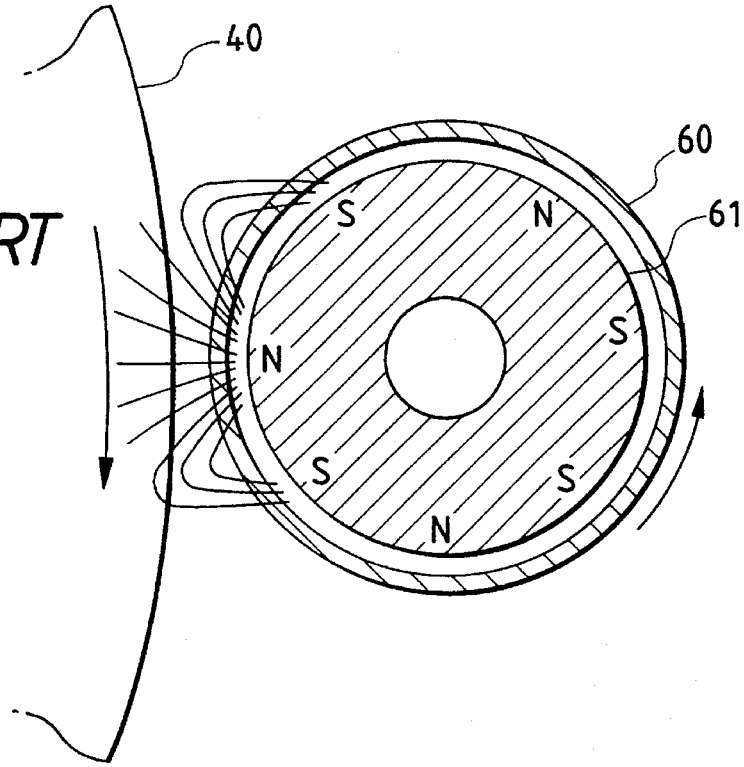
FIG. 9 PRIOR ART
FIG. 9 is an explanatory diagram showing a distribution of magnetic lines of flux in the developing region of a conventional developing unit.
Figure 10:
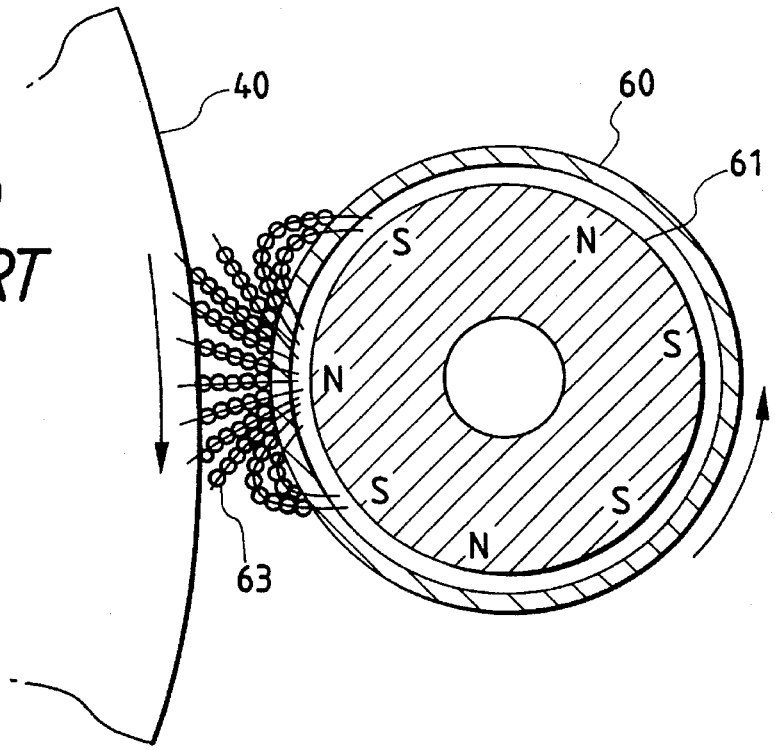
FIG. 10 PRIOR ART
FIG. 10 is an explanatory diagram showing a magnetic brush formed in the developing region of the conventional developing unit.

Thus, in the developing unit 21, the groove 32*a* of the magnet block 32 has the space 34 therein. Accordingly, a magnetic field is small in the region above the space 34. The intensity distribution of the magnetic field developed by the magnetic pole containing the magnet block 32 is profiled to have two peaks. The intensity distribution profile of the magnetic field is as shown in FIG. 7. A magnetic brush is formed in conformity with the intensity distribution profile. Accordingly, the width of the contact region of the thus formed magnetic brush with the latent electrostatic image bearing member is increased, as in the developing unit 1 of the first embodiment. The gradient of the intensity distribution profile between the two peaks is somewhat steeper than that in the developing unit 1, but is more gentle than that in the conventional art (U.S. Pat. No. 4,331,100) shown in FIG. 8. Accordingly, it is easy to obtain an intensity distribution of the magnetic field which is intensive and optimal but is capable of preventing the magnetic brush from being stirred abruptly and hence toner from being scattered. As in the first embodiment, the high skill is not required for working the magnet block 32 to form the groove 32*a*. This contributes to reduce the cost to manufacture the developing unit.

A method of manufacturing the developing unit 21 will be described. Ferrite is sintered into a magnet block 32 with a groove 32*a* of a predetermined shape. A mixture of powdery ferrite and binder is sintered into a substantially cylindrical roll base 31*a*. In this case, a groove for receiving the magnet block 32 is axially formed in advance in the surface region of the roll base 31*a*. The magnet block 32 is fit into the thus formed groove of the roll base 31*a* with the groove 32*a* of the magnet block 32 directed inward. A completed roll is cylindrical in shape and contains the magnet block 32 of which the groove 12*a* is empty or has the space 34. Thereafter, the cylindrical roll is magnetized to have a plural number of magnetic poles therein, as in the method of manufacturing the developing unit shown in FIG. 1. The result is formation of a cylindrical magnet roll 31 in which the magnet block 32 and part of the roll base 31*a* near the space 34 are magnetized to form a single magnetic pole.

Also in this manufacturing method, the height of two peaks of the intensity distribution profile, the width of each peak portion, and the difference of height between the peak and the bottom of the trough between the peaks can be changed, as desired, by properly selecting the dimensions (height, width, and depth) of the magnet block 32, the dimensions of the groove 32*a*, and the size of the space 34.

As described above, in the developing unit of the present invention, an intensively magnetized block is buried in a magnet roll at a location thereof where magnet roll faces the latent electrostatic image bearing member, with a groove formed in the intensively magnetized block being directed toward the axis of the magnet roll. A profile of an intensity distribution of the magnetic field formed by the magnetic pole at the location of the magnet roll where it faces the latent electrostatic image bearing member, has a plural number of peaks. Accordingly, the developing region is enlarged. Between the peaks, a magnetic brush loses its shape between the peaks and is formed again, so that the density of the developed image is increased. The height of and the distance between the peaks of the intensity distribution profile of the magnetic field in the developing region can easily be adjusted by making the groove of the magnet block empty or properly selecting a kind of a material filling the groove. Accordingly, the developing unit can be manufactured without any increase of the cost. Since the intensively magnetized block is directed toward the axis of the cylindrical magnet roll 11, the slopes of a curve representing the intensity distribution profile in the developing region are made gentle. Accordingly, the disturbance of the magnetic brush is not abrupt. Hence, toner is not scattered. Since the groove is provided in the intensively magnetized block, a high skill is not required for forming the groove. A magnetic field having a desired intensity profile can easily be obtained inexpensively.

What is claimed is:

1. A developing unit, comprising:

a latent electrostatic image bearing member;

a developing roll, including:

a tubular sleeve disposed facing said latent electrostatic image bearing member, said sleeve being driven for turn in the circumferential direction; and a cylindrical magnet roll fixedly supported within said sleeve; wherein a magnetic brush of a two-component developer is formed on said sleeve, and with turn of said sleeve, said two-component developer is transported to a developing region facing said latent electrostatic image bearing member, and in said developing region, a latent electrostatic image on said latent electrostatic image bearing member is developed into a visible image, said magnet roll, including:

a substantially cylindrical roll base made of a magnetic material; and an intensively magnetized block buried in said magnet roll at a location thereof where said magnet roll faces said latent electrostatic image bearing member, said intensively magnetized block being made of a material that is more intensively magnetized, by nature, than a material of said magnet roll, and said intensively magnetized block being U-shaped in cross section to form a groove that is uniformly extended over the substantially entire axial length of said magnet roll, the U-shaped side of said intensively magnetized block being directed toward the axis of said magnet roll, and said intensively magnetized block thus buried being magnetized to form a single magnetic pole in said magnet roll.

2. The developing unit of claim 1, wherein said groove of said intensively magnetized block is empty.

3. The developing unit of claim 2, wherein said roll base of said magnet roll is made of an isotropic ferrite magnetic material, and said intensively magnetized block is made of an anisotropic ferrite magnetic material.

4. The developing unit of claim 1, wherein said roll base of said magnet roll is made of an isotropic ferrite magnetic material, and said intensively magnetized block is made of an anisotropic ferrite magnetic material.

* * * * *